US006073922A

United States Patent [19]

Frattone

[11] Patent Number: 6,073,922

[45] Date of Patent: Jun. 13, 2000

[54] CLAMP APPARATUS

[75] Inventor: Ray Frattone, Richboro, Pa.

[73] Assignee: Stevens Engineering Inc., Phoenix, Ariz.

[21] Appl. No.: 09/388,497

[22] Filed: Sep. 2, 1999

[51] Int. Cl.[7] ..... B25B 1/04

[52] U.S. Cl. ..... 269/238; 269/234

[58] Field of Search ..... 269/238, 234

[56] References Cited

U.S. PATENT DOCUMENTS 1,490,063 4/1924 Tower ..... 269/238

FOREIGN PATENT DOCUMENTS 48009 9/1980 U.S.S.R. ..... 269/238

*Primary Examiner*—Timothy V. Eley
*Assistant Examiner*—Benjamin M. Halpern
*Attorney, Agent, or Firm*—Parsons & Goltry; Robert A. Parsons; Michael W. Goltry

[57] ABSTRACT

Clamp apparatus comprising a base, a rocker arm mounted at a location intermediate first and second portions thereof to the base for pivotal movement in opposition to the base, a first clamp element carried by the first portion, power transfer structure supported movably by the base and having drive and driven ends, a second clamp element carried by the driven end in substantial opposition to the first clamp element, and carried adjacent the second portion, a drive element responsive to application of a first force for exerting a second force to the drive end for pivoting the rocker arm to force the first clamp element against a work piece positioned between the first and second clamp elements, and for moving the power transfer structure to force the second clamp element against the work piece.

25 Claims, 2 Drawing Sheets

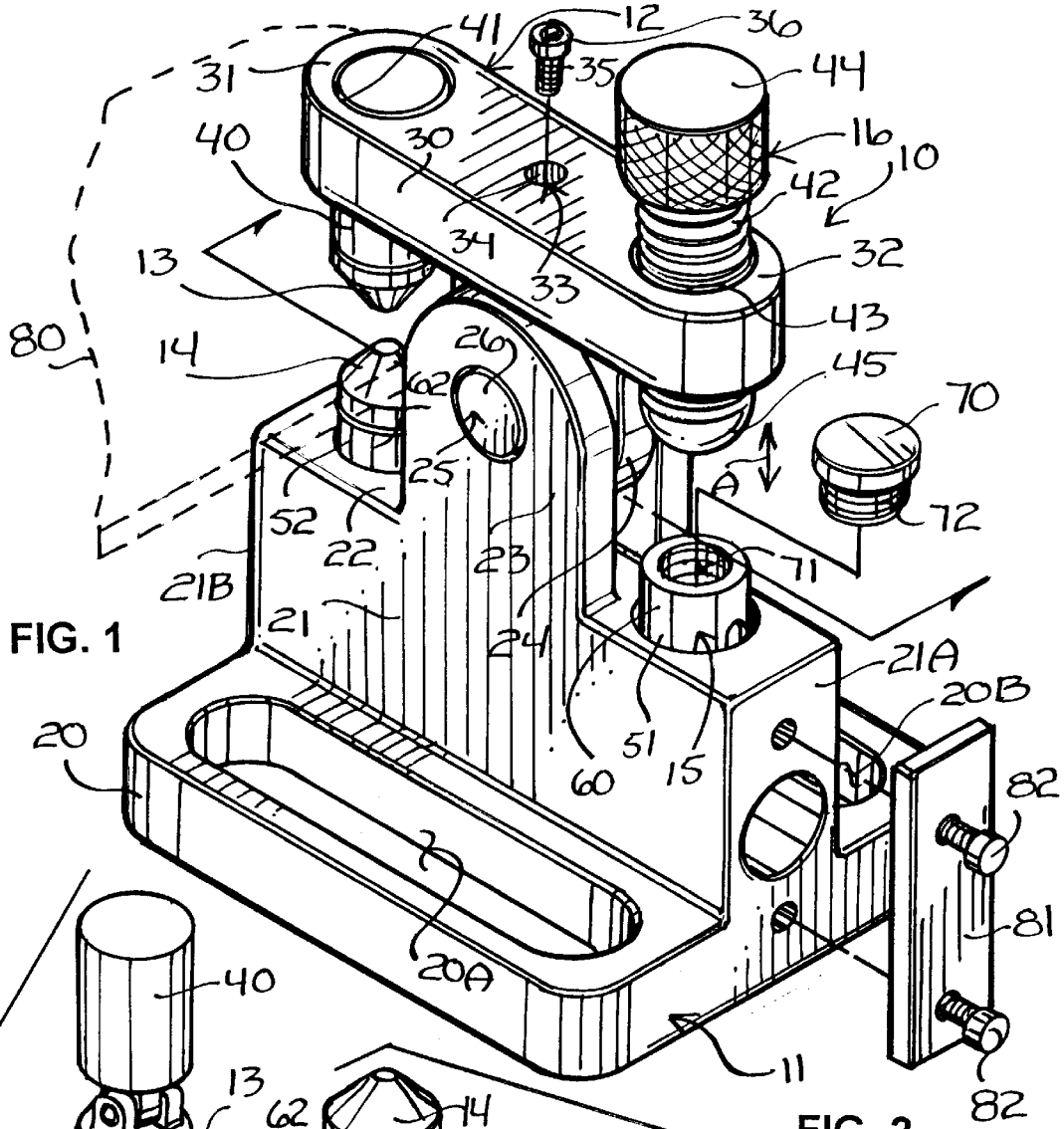
FIG. 1
FIG. 2
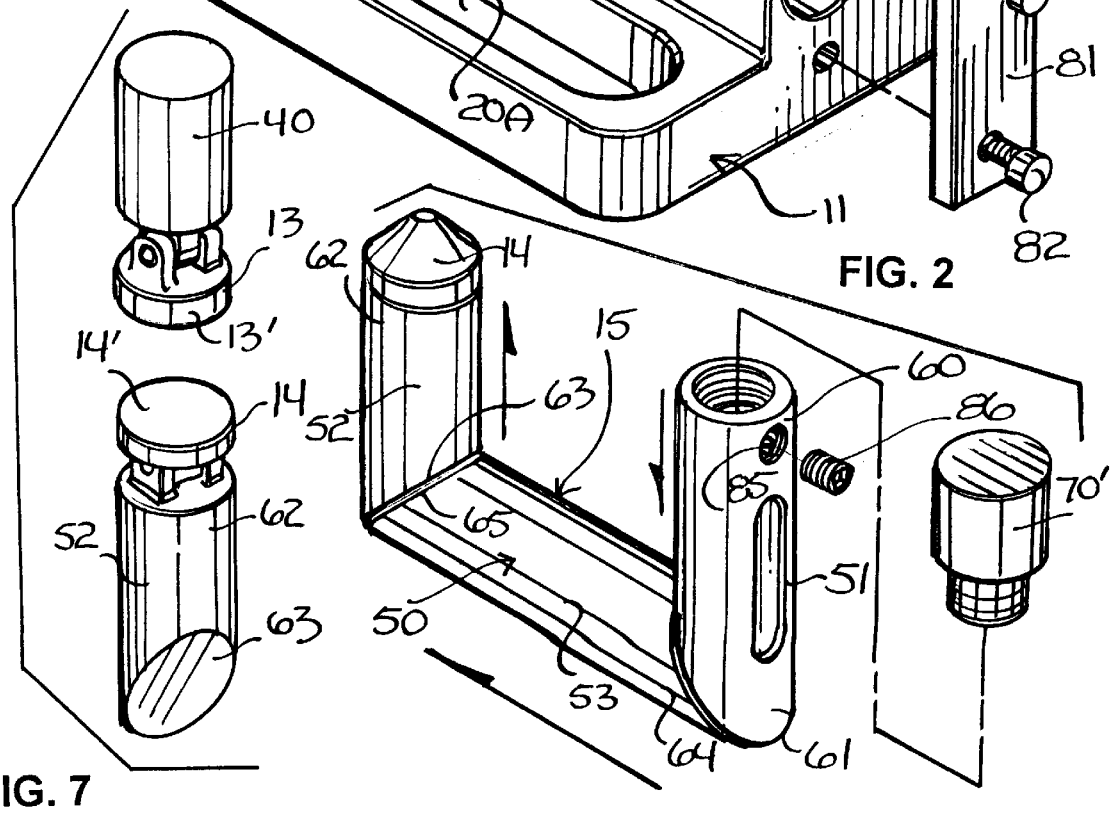
FIG. 7

FIG. 4
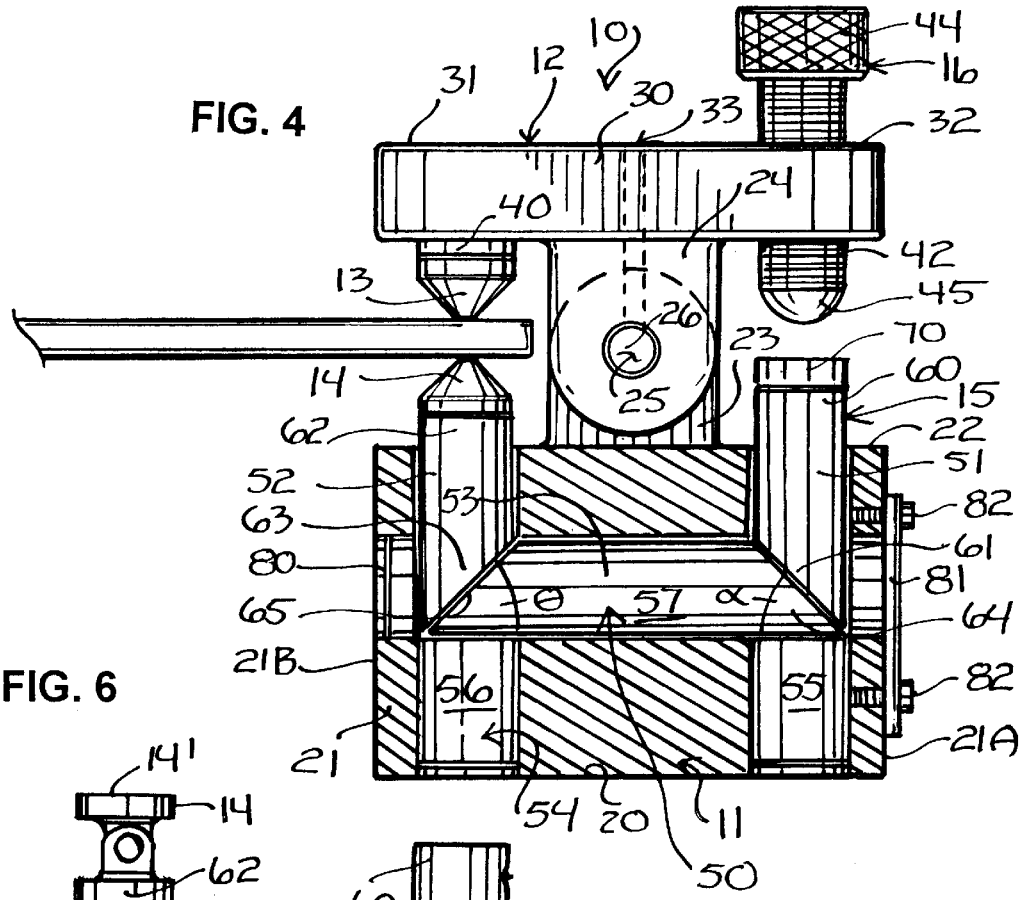
FIG. 6
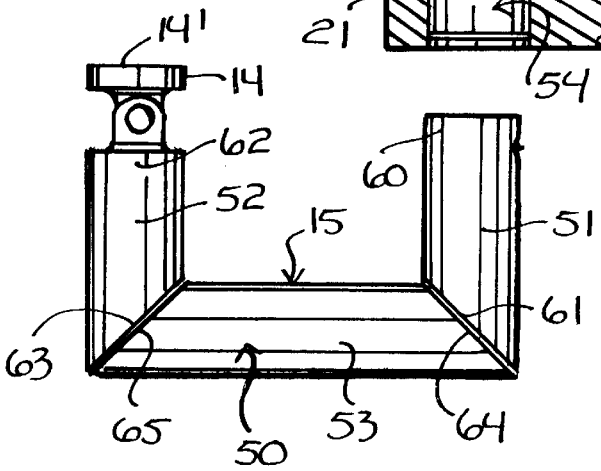
FIG. 3
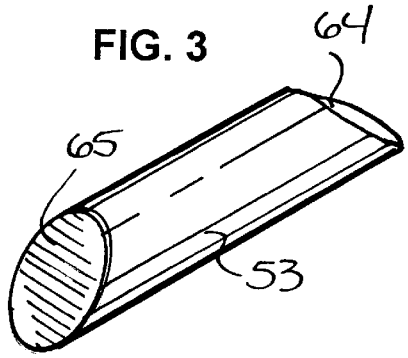
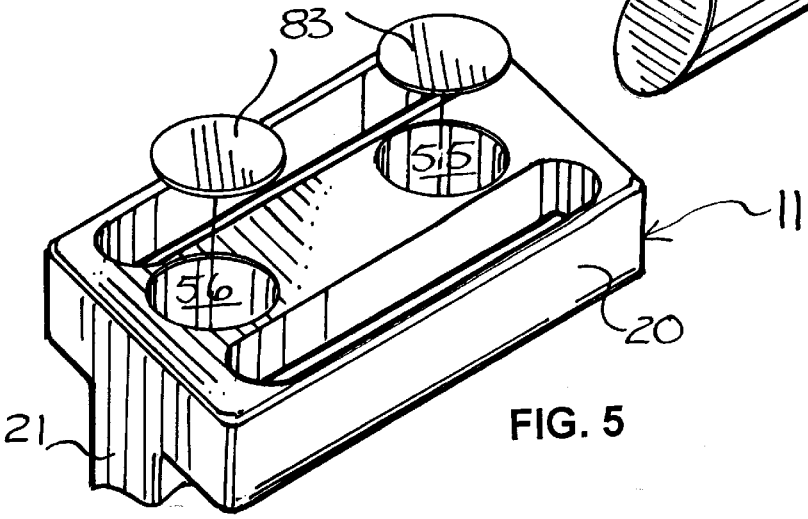
FIG. 5

CLAMP APPARATUS

FIELD OF THE INVENTION

This invention relates to clamps and, more particularly, to clamp apparatus for securing thin stock.

BACKGROUND OF THE INVENTION

The prior art is replete with clamp devices designed or adapted for securing or immobilizing thin, easily deflectable stock during machining operations. Thin cross-section stock, however, typically deflects or twists when clamped with such known clamp devices. This problem exacerbates when thin, flimsy stock, such as turbine shroud rings, turbine blades, propeller blades and butterfly valves, must be supported at many locations to prevent it from bending under cutting or other machine force. In view of these and other deficiencies in the art, the need for certain new and useful improvements is evident.

Accordingly, it would be highly desirable to provide new and improved clamp apparatus for securing thin stock.

It is therefore a purpose of the invention to provide new and improved clamp apparatus that is easy to construct.

It is another purpose of the invention to provide new and improved clamp apparatus that is easy to use.

It is still another purpose of the invention to provide new and improved clamp apparatus that is inexpensive to construct.

It is a further purpose of the invention to provide an exemplary and substantially non-damaging clamping of thin stock.

It is still a further purpose of the invention to provide new and improved clamp apparatus for accommodating stock of varying cross-sectional thickness.

It is yet still a further purpose of the invention to provide new and improved clamp apparatus that is safe to use.

It is another purpose of the invention to enhance productivity during thin stock machining operations.

It is still another purpose of the invention to reduce waste that can result from clamp damage to thin stock during manufacturing processes.

It is yet still another purpose of the invention to reduce the risk of bodily injury commonly associated with machining thin stock.

It is another provision of the invention to provide new and improved clamp apparatus that is easy to disassemble.

SUMMARY OF THE INVENTION

The above problems and others are at least partially solved and the above purposes and others realized in new and improved clamp apparatus for clamping thin stock. The clamp apparatus is comprised of a base and a rocker arm mounted at a point between first and second portions thereof to the base for pivotal or tottering movement in opposition to the base. The first portion supports a first clamp element in opposition to the base. The base supports power transfer structure which includes a drive end that faces the second portion of the rocker arm and a driven end that faces the first portion of the rocker arm. The driven end supports a second clamp in substantial opposition to the first clamp. The second portion of the rocker arm supports a drive element responsive to application of a first force for exerting a second force to the drive end for pivoting the rocker arm to force the first clamp element against thin stock positioned between the first and second clamp elements, and for moving the power transfer structure to force the second clamp element against the thin stock. The second force may be applied to the drive end directly or indirectly such as to an anvil supported by the drive end. In a particular embodiment, the power transfer structure comprises a plurality of actuating rods supported movably in angular abutment within a plurality of ways defined by the base. One of the actuating rods comprises a drive actuating rod that supports the drive end, and another one of the actuating rods comprises a driven actuating rod that supports the driven end.

Consistent with the foregoing, the invention also contemplates one or more associated methods of clamping thin stock.

BRIEF DESCRIPTION OF THE DRAWINGS

The foregoing and further and more specific objects and advantages of the invention will become readily apparent to those skilled in the art from the following detailed description taken in conjunction with the drawings in which:

FIG. 1 is an isometric view of clamp apparatus for securing thin stock comprising a base, a rocker arm mounted to the base for pivotal movement, a power transfer structure supported the base and having drive and driven ends, clamp elements carried by the rocker arm and the driven end of the power transfer apparatus, and a drive element carried by the rocker arm that in response to application of a force exerts another force against the drive end for moving the rocker arm and the power transfer structure for forcing the clamp elements against a work piece positioned therebetween;

FIG. 2 is an isometric view of the power transfer structure of FIG. 1, the power transfer structure comprising a plurality of angularly abutting actuating rods;

FIG. 3 is an isometric view of one of the actuating rods of FIG. 2;

FIG. 4 is a side elevational view of the clamp apparatus of FIG. 1 shown as it would appear holding thin stock, with the base shown in sectional view for the purpose of illustrating the power transfer structure;

FIG. 5 is a bottom isometric view of the base of FIG. 1;

FIG. 6 is a side elevational view of the power transfer structure of FIG. 2 shown as it would appear supporting another embodiment of a clamp element; and FIG. 7 is an isometric view of other embodiments of clamp elements for use with the clamp apparatus of FIG. 1.

DETAILED DESCRIPTION OF A PREFERRED EMBODIMENT

Turning to the drawings, in which like reference characters indicate corresponding elements throughout the several views, attention is first directed to FIG. 1 which illustrates an isometric view of clamp apparatus 10 for securing thin stock such as turbine shroud rings, turbine blades, propeller blades, butterfly valves and the like. The utility of the invention rests with its unique ability of clamping thin stock and of holding thin stock stationary while it is being machined or otherwise acted upon by a manual or motorized force. Clamp apparatus 10 is comprised of six main elements including a base 11, a rocker arm 12, opposing clamp elements 13 and 14, a power transfer structure 15 and a drive element 16, each of which may be constructed of one or more of the following including machined plastic, steel, aluminum or other malleable metal or metallic composite material. Base 11 is comprised of a foot 20 that supports a housing 21 which defines an outer or distal end 22 that opposes foot 20. Foot 20 defines elongated openings 20A and 20B on either side of housing 21 operative for accommodating various forms of apparatus for securing base 11 to a work surface. Housing 21 defines lateral or side extremities 21A and 21B, and accommodates and supports power transfer structure 15. A bifurcated structure 23 extends outwardly from distal end 22. Bifurcated structure 23 defines holes or apertures that support or accommodate a pivot pin 26. Bifurcated structure 23 is considered part of base 11.

Rocker arm 12 is comprised of an elongate member 30 that defines opposing portions or extremities 31 and 32. An elongate support 24 depends from elongate member 30 between the portions 31 and 32. Support 24 is considered part of rocker arm 12, and can be welded to, integrally molded with, or otherwise fixedly or removably engaged to elongate member 30. Support 24 is mounted for pivotal movement to pivot pin 26. In particular, support 24 defines a hole or aperture through which pivot pin 26 extends. Rocker arm 12 is thus supported away from bifurcated structure 23 for pivotal or tottering movement of rocker arm 12 in opposition to base 12 and, more particularly, in opposition to distal end 22 of base 11. In this scenario, support 24 would, of course, be considered part of the structure of rocker arm 12. Pivot pin 26 defines a pivot point 25 of rocker arm 12. Pivot pin 26 is preferably locked to support 24. To facilitate this, a point 33 of elongate member 30 is defined by bore 34 that extends into and through elongate member 30 and support 24, and which leads to pivot pin 26. Bore 34 functions as a key-way for accommodating a threaded fastener 35 which engages pivot pin 26 in the manner of a set-screw. Threaded fastener 35 defines an enlarged end 36 which seats against an annular seat (not shown) defined by bore 34 at support 24, which not only allows threaded fastener 35 to engage pivot pin 26, but also prevents it from passing completely through bore 34. Other conventional or suitable engagement structure for locking support 24 to pivot pin 26 may be employed with this invention.

With threaded fastener 35 removed, pivot pin 26 may be removed from bifurcated structure 23 and support 24 for facilitating the removal of rocker arm 12 from base 11. To install rocker arm 12, the apertures defined by the bifurcated structure 23 and support 24 may be aligned and pivot pin 26 forcibly driven into and through the aligned apertures, after which threaded fastener 35 may be passed through bore 34 and secured to pivot pin 26.

Portions 31 and 32 support clamp and drive elements 13 and 16, respectively. Clamp element 13 faces distal end 22 of base 11, and is carried by an elongate extension 40 fixed to and extending outwardly from portion 31 toward base 11. Although extension 40 may be integrally molded or machined with rocker arm 12, this embodiment shows extension 40 seized within a bore 41 extending through portion 31. Threaded or other suitable engagement structure may be incorporated for providing the detachable or removable engagement of extension 40 to portion 31 if so desired. Drive element 16 is comprised of a threaded member 42 supported threadably by and through a threaded bore 43 extending through portion 32. Threaded member 42 defines an enlarged proximal end 44 extending away from base 11 and a distal end 45 that faces base 11 and, more particularly, distal end 22 of base 11. Upon exertion of a rotational force to threaded member 42 applied at, for instance, enlarged proximal end 44, distal end 45 may be moved along a reciprocal path toward and away from base 11 as indicated generally by the double arrowed line A, further details of which will be discussed later in this specification.

Turning to FIGS. 2 and 4, further details concerning base 11 and power transfer structure 15 will now be addressed. Power transfer structure 15 is comprised of a plurality of actuating rods 50 supported movably by base 11. In this specific example, the plurality of actuating rods 50 comprises a drive actuating rod 51, a driven actuating rod 52 and an intermediate actuating rod 53. Although this invention incorporates three actuating rods, less or more may be used in accordance with this disclosure.

Regarding FIG. 4, base 11 defines a plurality of channels or ways 54 that support actuating rods 50. Ways 54 comprise a drive way 55, a driven way 56 and an intermediate or connector way 57. Drive and driven ways 55 and 56 are disposed in spaced apart and substantially parallel relation, and extend into and through housing 21 from distal end 22 to foot 20. At distal end 22, drive and driven ways 55 and 56 open toward and face portion 32 and 31, respectively. Intermediate way 57 extends through housing 21 between distal end 22 and foot 20 from lateral extremity 21A to lateral extremity 21B, and communicates with the drive and driven ways 55 and 56. Intermediate way 57 intersects the drive and driven ways 55 and 56 substantially at right angles, respectively.

Drive, driven and intermediate ways 55, 56 and 57 accommodate and support the drive, driven and intermediate actuating rods 51, 52 and 53, respectively. Although the ways 55, 56 and 57 and actuating rods 51, 52 and 53 have substantially cylindrical cross sections, this is not essential and other cross sectional shapes may be employed such as square, triangular, oval, etc. The drive, driven and intermediate ways 55, 56 and 57 are each of a size sufficient to permit the constrained reciprocal movement of the drive, driven and intermediate actuating rods 51, 52 and 53, respectively. The drive actuating rod 51 is elongate and defines a drive end 60 extending outwardly from drive way 55 facing portion 32 and an end 61 extending into drive way 55 toward foot 22. Driven actuating rod 52 is also elongate and defines a driven end 62 extending outwardly from driven way 56 facing portion 31 and an end 63 extending into driven way 56 toward foot 22. Ends 61 and 63 of drive and driven actuating rods 51 and 52 and ends 64 and 65 (see also FIG. 3) of intermediate actuating rod 53 abut or mate at angles $\alpha$ and $\theta$, respectively. Like the drive and driven actuating rods 51 and 53, the intermediate actuating rod 53 is elongate. Angles $\alpha$ and $\theta$ face one other and each preferably comprise a 45 degree angle of surface mating or abutment between the intermediate actuating rod 53 and the drive and driven actuating rods 51 and 52, although a somewhat steeper or shallower angle of abutment may be employed consistent with this disclosure.

Drive end 60 supports an anvil 70 in opposition to distal end 45 of drive element 16, and driven end 62 supports clamp element 14 in opposition to clamp element 13. Although anvil 70 can be welded to, integrally molded with or otherwise fixedly engaged or coupled to drive end 60, anvil 70 is preferably removably or detachably engaged to drive end 60. In the embodiment shown in FIG. 1, extending into drive end 60 is a threaded opening 71 sized for accommodating a threaded element 72 of anvil 70. Other conventional or suitable engagement structure for providing the detachable or removable engagement of anvil 70 to drive end 60 will readily occur to the skilled artisan. Like anvil 70, clamp element 14 can also be welded to, integrally molded with or otherwise fixedly engaged or coupled to driven end 62. However, clamp element 14 is preferably removably or detachably engaged to driven end 62 by way of a threaded engagement assembly or other conventional or suitable engagement structure.

Having described the general structural features of clamp apparatus 10, its functional attributes will now be addressed. As previously indicated, clamp apparatus 10 is ideal for clamping thin stock and holding it stationary while it is machined or otherwise acted upon by a manual or motorized force. Because of the unique structure of clamp apparatus 10, clamping force against thin stock is applied equally at the clamp elements 13 and 14 during the clamping operation by way of the combined and substantially contemporaneous movement of rocker arm 12 and power transfer structure 15. To clamp thin stock, which is shown in FIG. 1 in dotted outline and denoted by the reference character 80, it first must be positioned between clamp elements 13 and 14 as shown. So positioned, the clamping of thin stock 80 may be initiated. To clamp thin stock 80 with clamp elements 13 and 14, drive element 16 must be acted upon by a force to cause it to rotate to move distal end 45 toward, and into compressive engagement against, anvil 70. This rotational force may be applied at proximal end 44. In response to the continued application of the rotational force to drive element 16, anvil 70 will experience a continually increased compressive force from distal end 45 which, of course, is transferred to drive end 60. As this compressive force is applied, it will cause rocker arm 12 to pivot at pivot point 25 and move clamp element 13 toward and into engagement with one side of the thin stock 80.

In response to application of compressive or downward force at drive end 60 toward base 11, the arrangement of power transfer structure 15 allows it to move for moving clamp element 14 away from base 11 and toward and against the other side of the thin stock 80. In particular, as compressive force is applied toward base 11 to drive end 60, actuating rod 51 will move downwardly through drive way 55 in a direction toward foot 20. As drive actuating rod 51 moves toward foot 20, the angular abutment of end 61 of drive actuating rod 51 and end 64 of intermediate actuating rod 53 as defined by the angle $\alpha$ will cause the ends 61 and 64 to slide against one another, forcing intermediate actuating rod 53 to move toward lateral extremity 21B. As intermediate actuating rod 53 moves toward lateral extremity 21B, the angular abutment of end 65 of intermediate actuating rod 53 and end 63 of driven actuating rod 52 as defined by the angle $\theta$ will cause ends 65 and 63 to slide against one another, forcing driven actuating rod 52 to move toward portion 31 and, more particularly, toward the other side of the thin stock 80, which will ultimately result in the engagement of clamp element 14 against the other side of the thin stock 80. As compressive force is applied to drive end 60, the foregoing movement of the rocker arm 12 and the drive, intermediate and driven actuating rods 51, 53 and 52 occurs substantially simultaneously, which results in the clamping of the thin stock 80 by the clamp elements 13 and 14, with equal clamping force being applied across the clamp elements 13 and 14 to the thin stock 80. To remove the clamping force of the clamp elements 13 and 14 against the thin stock 80 to release it, the foregoing operation need only be reversed.

Openings at lateral extremities 21A and 21B leading to intermediate way 57 may be covered or otherwise occluded with a plug 80 shown in FIG. 4 at lateral extremity 21B, or perhaps a face plate 81 (FIGS. 1 and 4) at lateral extremity 21A engagable to housing 21 via threaded fasteners 82 or the like. Similarly, openings extending through foot 20 leading to the drive and driven ways 55 and 56 as shown in FIG. 5 may also be occluded with plugs 83. The power transfer structure 15 may be easily installed into the drive, driven and intermediate ways 55, 56 and 57 by way of these described openings. To accommodate thin stock of varying thickness, the removability of rocker arm 12 allows it to be removed and replaced with any one of a variety of other rocker arms of differing size for providing various ranges of clearance between the clamping elements 13 and 14 for allowing the easy and efficient clamping of thin stock having varying thickness. As the clearance between the clamping elements 13 and 14 is varied, anvil 70 may be removed and replaced with any one of a variety of other anvils of differing size for ensuring the operative relationship between the drive element 16 and the power transfer structure 15. FIG. 2 illustrates an anvil 70' having a greater size than anvil 70 shown in FIGS. 1 and 4 for the purpose of illustrating this point. Furthermore, FIG. 2 also illustrates a threaded opening 85 formed through drive actuating rod 51 adjacent drive end 60 for accommodating a threaded member 86 for providing further engagement of a selected anvil to drive end 60.

The invention has been described above with reference to one or more preferred embodiments. However, those skilled in the art will recognize that changes and modifications may be made in the described embodiments without departing from the nature and scope of the invention. For instance, although drive element 16 is constructed to move in reciprocal directions upon application of a rotational force, it may be constructed and designed for moving in reciprocal directions in response to application of one or more other forces. Also, clamp elements 13 and 14 are each shown having a conical shape. Depending on specific clamping needs, other shapes may be used. As a matter of example, clamp elements 13 and 14, extension 40 and driven actuating rod 52 preferably incorporate threaded or other forms of detachable engagement structure for allowing other forms of clamp elements to be installed and used. In FIG. 7, clamp elements 13 and 14 are shown as pivotally mounted clamping faces 13' and 14' (clamping face 14' shown also in FIG. 6) for the purpose of illustrating this point.

Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. Clamp apparatus comprising:

a base;

a rocker arm mounted at a point between first and second portions thereof to the base for pivotal movement in opposition to the base;

a first clamp element carried by the first portion;

power transfer structure supported movably by the base and having drive and driven ends;

a second clamp element carried by the driven end in substantial opposition to the first clamp element; and carried adjacent the second portion, a drive element responsive to application of a first force for exerting a second force to the drive end for pivoting the rocker arm to force the first clamp element against thin stock positioned between the first and second clamp elements, and for moving the power transfer structure to force the second clamp element against the thin stock.

2. Clamp apparatus of claim 1, wherein the first clamp element is removably carried by the first portion.

3. Clamp apparatus of claim 1, wherein the second clamp element is removably carried by the driven end.

4. Clamp apparatus of claim 1, wherein the rocker arm is removably mounted to the base.

5. Clamp apparatus of claim 1, wherein the power transfer structure comprises angularly abutting actuating rods, one of the actuating rods supporting the drive end, and another one of the actuating rods supporting the driven end.

6. Clamp apparatus of claim 5, wherein the actuating rods are supported movably in a plurality of ways defined by the base.

7. Clamp apparatus of claim 6, wherein each one of the ways intersects another one of the ways.

8. Clamp apparatus of claim 1, wherein the first force comprises a rotational force.

9. Clamp apparatus of claim 1, wherein the second force comprises a compressive force.

10. Clamp apparatus of claim 1, wherein the drive end supports an anvil that receives the second force.

11. Clamp apparatus of claim 10, wherein the anvil is removable.

12. Clamp apparatus comprising:

a base;

a pivot point of the base detachably accommodating a rocker arm between first and second portions thereof for pivotal movement in opposition to the base;

a first clamp element carried by the first portion;

power transfer structure supported movably by the base and having drive and driven ends;

a second clamp element carried by the driven end in substantial opposition to the first clamp element; and carried adjacent the second portion, a drive element responsive to application of a first force for exerting a second force to the drive end for pivoting the rocker arm to force the first clamp element against thin stock positioned between the first and second clamp elements, and for moving the power transfer structure to force the second clamp element against the thin stock;

the rocker arm having a size sufficient to permit the first and second clamp elements to accommodate the thin stock.

13. Clamp apparatus of claim 12, wherein the first clamp element is removably carried by the first portion.

14. Clamp apparatus of claim 12, wherein the second clamp element is removably carried by the driven end.

15. Clamp apparatus of claim 12, wherein the power transfer structure comprises angularly abutting actuating rods, one of the actuating rods supporting the drive end, and another one of the actuating rods supporting the driven end.

16. Clamp apparatus of claim 15, wherein the actuating rods are supported movably in a plurality of ways defined by the base.

17. Clamp apparatus of claim 16, wherein each one of the ways intersects another one of the ways.

18. Clamp apparatus of claim 12, wherein the first force comprises a rotational force.

19. Clamp apparatus of claim 12, wherein the second force comprises a compressive force.

20. Clamp apparatus of claim 12, wherein the drive end supports an anvil that receives the second force.

21. Clamp apparatus of claim 20, wherein the anvil is removable.

22. A method of securing thin stock comprising the steps of:

providing a rocker arm having first and second portions, a first clamp element carried by the first portion and a drive element carried by the second portion;

providing power transfer structure supported movably by a base and having a drive end, a driven end and a second clamp element carried by the driven end;

engaging the rocker arm between the first and second portions thereof to the base for pivotal movement with the first clamp element facing the second clamp element and the drive element facing drive end;

positioning thin stock between the first and second clamp elements; and applying a first force to the drive element for imparting a second force to the drive end for pivoting the rocker arm to force the first clamp element against the thin stock, and for moving the power transfer structure to force the second clamp element against the thin stock.

23. The method of claim 22, wherein the step of providing power transfer structure further includes the step of providing a plurality of actuating rods supported movably in angular abutment by the base, one of the actuating rods supporting the drive end and another one of the actuating rods supporting the driven end.

24. The method of claim 22, wherein the step of applying a first force to the drive element for imparting a second force to the drive end further includes the step of applying a rotational force to the drive element for imparting a compressive force to the drive end.

25. The method of claim 22, wherein the step of providing a rocker arm further includes the step of providing a rocker arm of a size sufficient to permit the first and second clamp elements to accommodate the work piece.

* * * * *